US010359801B1

(12) United States Patent
Chen et al.

(10) Patent No.: US 10,359,801 B1
(45) Date of Patent: Jul. 23, 2019

(54) VOLTAGE REFERENCE GENERATOR WITH LINEAR AND NON-LINEAR TEMPERATURE DEPENDENCY ELIMINATION

(71) Applicant: Iowa State University Research Foundation, Inc., Ames, IA (US)

(72) Inventors: Degang James Chen, Ames, IA (US); Zhiqiang Liu, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 15/991,387

(22) Filed: May 29, 2018

(51) Int. Cl.
*G05F 3/30* (2006.01)
*G05F 3/22* (2006.01)

(52) U.S. Cl.
CPC . *G05F 3/30* (2013.01); *G05F 3/22* (2013.01)

(58) Field of Classification Search
CPC ..... G05F 3/222–3/227; G05F 3/242–3/245; G05F 1/567; G05F 3/16–3/30
USPC ..... 323/13, 14, 907
See application file for complete search history.

(56) References Cited

U.S. PATENT DOCUMENTS 5,666,046 A 9/1997 Mietus
7,161,340 B2 * 1/2007 Chiu ..... G05F 3/262 323/316
8,446,141 B1 5/2013 McGinn
9,667,259 B2 * 5/2017 Goumballa ..... H03K 3/011
2006/0061412 A1 3/2006 Molina et al.
2013/0234781 A1 9/2013 Bernardinis
2014/0015504 A1 * 1/2014 Sano ..... G05F 3/30 323/282
2015/0338872 A1 * 11/2015 Afzal ..... G05F 3/30 323/313
2016/0004269 A1 * 1/2016 Ivanov ..... G05F 3/20 327/321
2016/0124445 A1 5/2016 Jain et al.
2019/0113946 A1 * 4/2019 Nicollini ..... G05F 3/225

OTHER PUBLICATIONS

Andreou, Charalambos, et al., "A Novel Wide-Temperature-Range, 3.9 ppm/C CMOS Bandgap Reference Circuit," Journal of Solid-State Circuits, vol. 47, Issue 2, Feb. 2012, IEEE, pp. 574-581.

(Continued)

*Primary Examiner* — Gary L Laxton
*Assistant Examiner* — Peter M Novak
(74) *Attorney, Agent, or Firm* — Withrow & Terranova, P.L.L.C.

(57) ABSTRACT

The present disclosure relates to a voltage reference generator without temperature dependency. The disclosed voltage reference generator includes a precursor voltage generator and a voltage extractor. The precursor voltage generator is configured to provide a base-emitter voltage, a proportional-to-absolute-temperature (PTAT) voltage, and a nonlinear (NL) voltage. The voltage extractor is configured to scale and sum the base-emitter voltage, the NL voltage, and the PTAT voltage and provide an output voltage, such that linear temperature dependent components and nonlinear temperature dependent components within the base-emitter voltage, the NL voltage, and the PTAT voltage are not included in the output voltage, which is temperature independent.

21 Claims, 6 Drawing Sheets

(56) References Cited

OTHER PUBLICATIONS

Author Unknown, "0.25ppm Noise, Low Drift Precision References," Technical Data Sheet, LTC6655, 2009, Linear Technology Corporation, 26 pages.
Author Unknown, "Low-Noise, Very Low Drift, Precision Voltage Reference," Technical Data Sheet, REF50XX, SBOS410H, Revised Jun. 2016, Texas Instruments, 38 pages.
Author Unkown, "Ultra-High-Precision, Ultra-Low-Noise, Series Voltage Reference," Technical Data Sheet, MAX6125, Revision 8, Jun. 2016, Maxim Integrated, 20 pages.
Bludau, W., et al., "Temperature dependence of the band gap of silicon," Journal of Applied Physics, vol. 45, Issue 4, Apr. 1974, American Institute of Physics, pp. 1846-1848.
Duan, Quanzhen, et al., "A 1.2-V 4.2-ppm/C High-Order Curvature-Compensated Cmos Bandgap Reference," IEEE Transactions on Circuits and Systems, Regular Papers, vol. 62, Issue 3, Mar. 2015, pp. 662-670.
Ge, Guang, et al., "A Single-Trim CMOS Bandgap Reference with a 3a Inaccuracy of 0.15% from –40C to 125C," International Solid-State Circuits Conference, Session 4, Feb. 8, 2010, pp. 78-80.
Gunawan, Made, et al., "A Curvature-Corrected Low-Voltage Bandgap Reference," Journal of Solid-State Circuits, vol. 28, Issue 6, Jun. 1993, IEEE, pp. 667-670.
Li, Jing-Hu, et al., "A 1.2-V Piecewise Curvature-Corrected Bandgap Reference in 0.5 um CMOS Process," IEEE Transactions on Very Large Scale Integration (VLSI) Systems, vol. 19, Issue 6, Jun. 2011, pp. 1118-1122.
Ma, Bill, et al., "A Novel 1.2-V 4.5-ppm/C Curvature-Compensated CMOS Bandgap Reference," Transactions on Circuits and Systems, Regular Papers, vol. 61, Issue 4, Apr. 2014, IEEE, pp. 1026-1035.
Malcovati, Piero, et al., "Curvature-Compensated BiCMOS Bandgap with 1-V Supply Voltage," Journal of Solid-State Circuits, vol. 36, Issue 7, Jul. 2001, IEEE, pp. 1076-1081.
Mok, Philip, et al., "Design Considerations of Recent Advanced Low-Voltage Low-Temperature-Coefficient CMOS Bandgap Voltage Reference," Custom Integrated Circuits Conference, 2004, IEEE, pp. 635-642.
Oberhuber, Ralph, et al., "A 1 ppm/C bandgap voltage reference with new second-order Taylor curvature compensation," International SOC Conference, Sep. 2010, IEEE, pp. 71-75.
Rincon-Mora, Gabriel, et al., "A 1.1-V Current-Mode and Piecewise-Linear Curvature-Corrected Bandgap Reference," Journal of Solid-State Circuits, vol. 33, Issue 10, Oct. 1998, IEEE, pp. 1551-1554.
Song, Bang-Sup, et al., "A Precision Curvature-Compensated CMOS Bandgap Reference," Journal of Solid-State circuits, vol. Sc-18, Issue 6, Dec. 1983, IEEE, pp. 634-643.
Tsividis, Yannis, "Accurate Analysis of Temperature Effects in IC-VBE Characteristics with Application to Bandgap Reference Sources," Journal of Solid-State Circuits, vol. SC-15, Issue 6, Dec. 1980, IEEE, pp. 1076-1084.
Ueno, Ken, et al., "A 300 nW, 15 ppm/C, 20 ppm/V CMOS Voltage Reference Circuit Consisting of Subthreshold MOSFETs," Journal of Solid-State Circuits, vol. 44, Issue 7, Jul. 2009, IEEE, pp. 2047-2054.
Wang, Bo, et al., "A Precision CMOS Voltage Reference Exploiting Silicon Bandgap Narrowing Effect," vol. 62, Issue 7, Jul. 2015, IEEE, pp. 2128-2135.
Zhou, Ze-Kun, et al., "A 1.6-V 25-uA 5-ppm/C Curvature-Compensated Bandgap Reference," Transactions on circuits and Systems, Regular Papers, vol. 59, Issue 4, Apr. 2012, IEEE, pp. 677-684.

* cited by examiner

VOLTAGE REFERENCE GENERATOR WITH LINEAR AND NON-LINEAR TEMPERATURE DEPENDENCY ELIMINATION

FIELD OF THE DISCLOSURE

The present disclosure relates to a voltage reference generator, and more particularly to a voltage reference generator without temperature dependency.

BACKGROUND

The accuracy of voltage reference determines the maximum achievable performance of almost all mixed-signal and radio-frequency (RF) systems. The increasing demand of modern high-performance circuits such as voltage regulators, high-resolution data converters, and precision measurement systems, requires a highly accurate reference voltage.

Nowadays, both the gate-source voltage of a metal-oxide-semiconductor field-effect transistor (MOSFET) and the base-emitter/diode voltage ($V_{BE}$) of a bipolar junction transistor (BJT) are widely utilized to generate the reference voltage. Typically, the $V_{BE}$ of a BJT is better characterized over temperature and varies less than the threshold voltage and mobility of a MOSFET. However, the $V_{BE}$ of a BJT has nonlinearity over a temperature range, which causes difficulties in achieving superior low temperature dependency of the voltage reference.

Accordingly, there remains a need for an improved voltage reference generator design that utilizes the $V_{BE}$ of BJTs and provides a superior accurate reference voltage without temperature dependency.

SUMMARY

The present disclosure relates to a voltage reference generator without temperature dependency. The disclosed voltage reference generator includes a precursor voltage generator and a voltage extractor coupled to the precursor voltage generator. The precursor voltage generator includes a first reference unit generating a first voltage, a second reference unit generating a second voltage, and a third reference unit generating a third voltage. The precursor voltage generator is configured to provide the second voltage that includes a temperature independent component, a first linear temperature dependent component, and a first nonlinear temperature dependent component; a proportional-to-absolute-temperature (PTAT) voltage that is a function of the first voltage and the second voltage, and includes a second linear temperature dependent component; and a nonlinear (NL) voltage that is a function of the second voltage and the third voltage, and includes a third linear temperature dependent component and a second nonlinear temperature dependent component. The voltage extractor is configured to generate an output voltage by scaling and summing the second voltage, the NL voltage, and the PTAT voltage. As such, the first linear temperature dependent component, the second linear temperature dependent component, and the third linear temperature dependent component cancel out one another and are not included in the output voltage. The first nonlinear temperature dependent component and the second nonlinear temperature dependent component cancel out one another and are not included in the output voltage. The output voltage is essentially temperature independent and proportional to the temperature independent component.

In one embodiment of the voltage reference generator, the precursor voltage generator and the voltage extractor are free of resistors.

In one embodiment of the voltage reference generator, each of the first reference unit, the second reference unit, and the third reference unit includes a diode. Herein, a cathode of the diode is coupled to ground.

In one embodiment of the voltage reference generator, each of the first reference unit, the second reference unit, and the third reference unit includes a bipolar junction transistor (BJT). Herein, a base and a collector of the BJT are shorted and coupled to ground.

In one embodiment of the voltage reference generator, a first current injected into the first reference unit and a second current injected into the second reference unit have a same temperature dependency, and the first current and a third current injected into the third reference unit have different temperature dependencies.

In one embodiment of the voltage reference generator, the output voltage is equal to the temperature independent component.

In one embodiment of the voltage reference generator, the output voltage is smaller than the temperature independent component.

In one embodiment of the voltage reference generator, the temperature independent component is a band gap voltage of silicon extrapolated at zero Kevin.

In one embodiment of the voltage reference generator, the voltage extractor includes a first voltage scaling block, a second voltage scaling block, a third voltage scaling block, and a summing block. The first voltage scaling block has a first scaling factor, and is configured to receive the second voltage and provide a scaled second voltage. The second voltage scaling block has a second scaling factor, and is configured to receive the PTAT voltage and provide a scaled PTAT voltage. The third voltage scaling block has a third scaling factor, and is configured to receive the NL voltage and provide a scaled NL voltage. The summing block is configured to receive and sum the scaled second voltage, the scaled PTAT voltage, and the scaled NL voltage, and configured to provide the output voltage. Herein, the first scaling factor, the second scaling factor, and the third scaling factor are different. Each of the first voltage scaling block, the second voltage scaling block, and the third voltage scaling block is implemented by at least one of an operational amplifier (op-amp) and a resistive network. The summing block is implemented by a summing amplifier or a voltage adder.

In one embodiment of the voltage reference generator, the second voltage is provided at a first port of the precursor voltage generator, the PTAT voltage is provided at a second port of the precursor voltage generator, and the NL voltage is provided at a third port of the precursor voltage generator. The voltage extractor includes a first scaling resistor, a second scaling resistor, a third scaling resistor, a feedback resistor, and an op-amp. The first scaling resistor is coupled between the first port and a negative input of the op-amp, the second scaling resistor is coupled between the second port and the negative input of the op-amp, and the third scaling resistor is coupled between the third port and the negative input of the op-amp. The first scaling resistor, the second scaling resistor, and the third scaling resistor have different resistances. The feedback resistor is coupled between the negative input of the op-amp and an output of the op-amp. A positive input of the op-amp is coupled to ground, and the output voltage is provided at the output of the op-amp.

In one embodiment of the voltage reference generator, the voltage extractor further includes a first buffer coupled between the first port and the first scaling resistor, a second buffer coupled between the second port and the second scaling resistor, and a third buffer coupled between the third port and the third scaling resistor. Herein, each of the first buffer, the second buffer, and the third buffer is implemented by a unit gain inverting amplifier.

In another embodiment, the disclosed voltage reference generator includes a precursor voltage generator and a voltage extractor coupled to the precursor voltage generator. The precursor voltage generator includes a first reference unit generating a first voltage, a second reference unit generating a second voltage, and a third reference unit generating a third voltage. The precursor voltage generator is configured to provide the second voltage that includes a temperature independent component, a first linear temperature dependent component, and a first nonlinear temperature dependent component; a PTAT voltage that is a function of the first voltage and the second voltage, and includes a second linear temperature dependent component; and an NL voltage that is a function of the second voltage and the third voltage, and includes a third linear temperature dependent component and a second nonlinear temperature dependent component. The voltage extractor providing an output voltage is configured to convert and scale the second voltage, the NL voltage, and the PTAT voltage into a scaled second current, a scaled NL current, and a scaled PTAT current, respectively. The voltage extractor is configured to sum the scaled second current, the scaled NL current, and the scaled PTAT current to provide a summed current. The first linear temperature dependent component, the second linear temperature dependent component, and the third linear temperature dependent component cancel out one another and are not included in the summed current. The first nonlinear temperature dependent component and the second nonlinear temperature dependent component cancel out one another and are not included in the summed current. The voltage extractor is configured to convert the summed current into the output voltage, which is essentially temperature independent and proportional to the temperature independent component.

In one embodiment of the voltage reference generator, the voltage extractor includes a first voltage to current (V-I) converter, a second V-I converter, a third V-I converter, a first current scaling block, a second current scaling block, a third current scaling block, and a current to voltage (I-V) converter. Herein, the second voltage is converted to the scaled second current by the first V-I converter and the first current scaling block. The PTAT voltage is converted to the scaled PTAT current by the second V-I converter and the second current scaling block. The NL voltage is converted to the scaled NL current by the third V-I converter and the third current scaling block. The I-V converter is configured to convert the summed current into the output voltage.

In one embodiment of the voltage reference generator, the voltage extractor further includes a current adder, wherein the current adder is configured to receive the scaled second current, the scaled PTAT current, and the scaled NL current, and provide the summed current to the I-V converter.

In one embodiment of the voltage reference generator, a first output port of the first current scaling block, a second output port of the second current scaling block, and a third output port of the third current scaling block are connected together and coupled to an input of the I-V converter.

In another embodiment, the disclosed voltage reference generator includes a precursor voltage generator, an analog to digital converter (ADC), a digital voltage extractor, and a digital to analog converter (DAC). The precursor voltage generator includes a first reference unit generating a first voltage, a second reference unit generating a second voltage, and a third reference unit generating a third voltage. The precursor voltage generator is configured to provide the second voltage that includes a temperature independent component, a first linear temperature dependent component, and a first nonlinear temperature dependent component; a PTAT voltage that is a function of the first voltage and the second voltage, and includes a second linear temperature dependent component; and an NL voltage that is a function of the second voltage and the third voltage, and includes a third linear temperature dependent component and a second nonlinear temperature dependent component. The ADC is coupled to the precursor voltage generator and configured to convert the second voltage, the PTAT voltage, and the NL voltage from an analog domain to a digital domain. The digital voltage extractor is configured to generate an output voltage by scaling and summing the second voltage, the NL voltage, and the PTAT voltage in the digital domain. As such, the first linear temperature dependent component, the second linear temperature dependent component, and the third linear temperature dependent component cancel out one another and are not included in the output voltage. The first nonlinear temperature dependent component and the second nonlinear temperature dependent component cancel out one another and are not included in the output voltage. The output voltage is essentially temperature independent and proportional to the temperature independent component. The DAC is configured to convert the output voltage from the digital domain to the analog domain.

In one embodiment of the voltage reference generator, the digital voltage extractor is implemented by a digital signal processor.

In one embodiment of the voltage reference generator, the ADC and the DAC share a same reference voltage.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 1A:
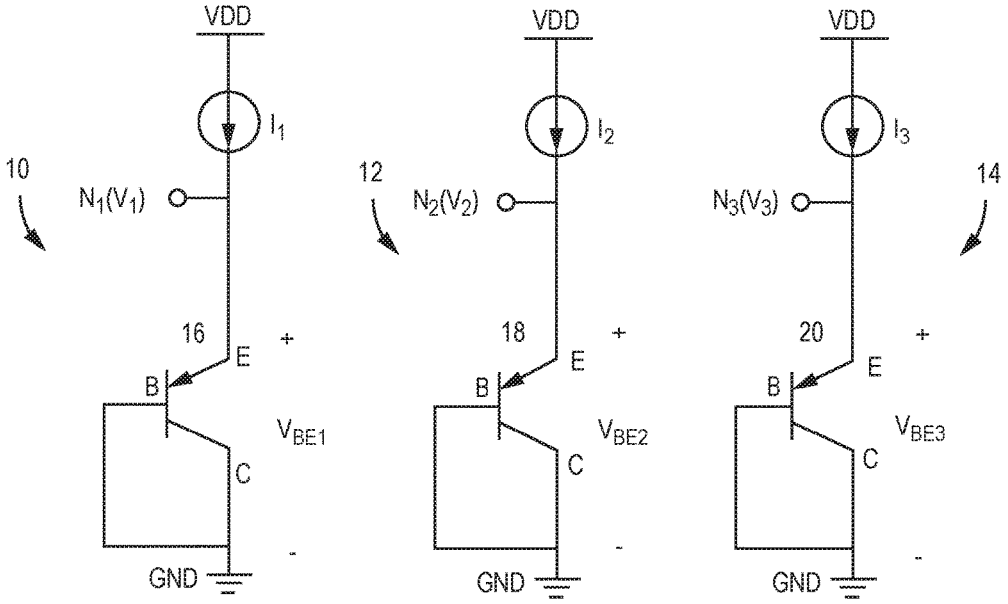
FIGS. 1A-1B show exemplary bipolar junction transistors/diodes which are utilized to provide a proportional-to-absolute-temperature voltage, a complementary-to-absolute-temperature voltage, and a nonlinear voltage.

It will be understood that for clear illustrations, FIGS. 1A-6 may not be drawn to scale.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

FIG. 1A shows a first reference unit 10, a second reference unit 12, and a third reference unit 14, which are utilized to provide a proportional-to-absolute-temperature (PTAT) voltage $V_{PTAT}$, a complementary-to-absolute-temperature (CTAT) voltage $V_{CTAT}$, and a nonlinear (NL) voltage $V_{NL}$. The PTAT voltage $V_{PTAT}$, the CTAT voltage $V_{CTAT}$, and the NL voltage $V_{NL}$ are used to generate a band gap voltage of silicon extrapolated at zero Kevin $V_{GO}$ in a voltage reference generator (details are shown below).

Figure 1B:
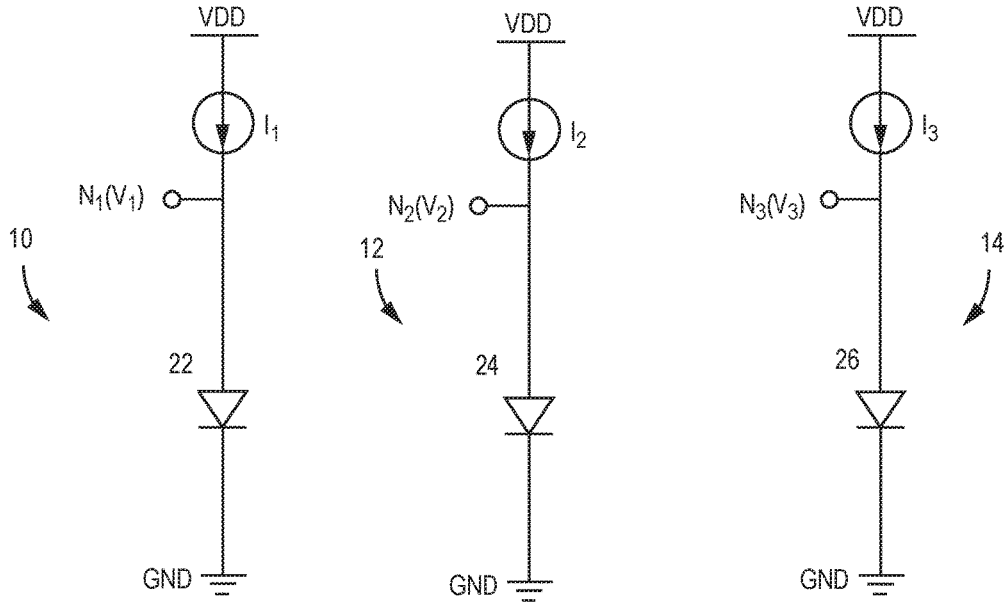

In this embodiment, the first, second, and third reference units 10, 12, and 14 include a first bipolar junction transistor (BJT) 16, a second BJT 18, and a third BJT 20, respectively. Each of the first, second, and third BJTs 16, 18, and 20 is connected as a diode. A base (B) and a collector (C) of each of the first, second, and third BJTs 16, 18, and 20 are connected together and coupled to ground. An emitter (E) of the first BJT 16 is coupled to a first node N1 of the first reference unit 10 with a first voltage V1, an emitter (E) of the second BJT 18 is coupled to a second node N2 of the second reference unit 12 with a second voltage V2, and an emitter (E) of the third BJT 20 is coupled to a third node N3 of the third reference unit 14 with a third voltage V3. In some applications, the first, second, and third BJTs 16, 18, and 20 may be replaced by first, second and third diodes 22, 24, and 26, as illustrated in FIG. 1B. Herein, the PTAT voltage $V_{PTAT}$ is a function of the first voltage and the second voltage; the CTAT voltage $V_{CTAT}$ is the second voltage $V_2$, which is also a base-emitter voltage $V_{BE2}$ of the second BJT 18; the NL voltage $V_{NL}$ is a function of the second voltage and the third voltage; defined as:

$$V_{PTAT}(T)=V_1-V_2 \tag{1}$$

$$V_{CTAT}(T)=V_2=V_{BE2}(T) \tag{2}$$

$$V_{NL}(T)=V_2-V_3 \tag{3}$$

The emitter area ratios of the first, second, and third BJTs 16, 18, and 20 are equal to n:1:1. $I_1$ is a current injected into the first reference unit 10 and has a property $I_1=F_1\times T^{\delta_1}$. $I_2$ is a current injected into the second reference unit 12 and has a property $I_2=mI_1$. $I_3$ is a current injected into the third reference unit 14 and has a property $I_3=F_2\times T^{\delta_2}$. $F_1$ and $F_2$ are two temperature-independent coefficients, T is the absolute temperature in Kelvin, $\delta_1$ and $\delta_2$ are two constant integer numbers ($\delta_1\neq\delta_2$), and m is the ratio between the currents $I_2$ and $I_1$. It is clear that $I_1$ and $I_2$ have a same temperature dependency, while the currents $I_1$ and $I_3$ have different temperature dependencies. One easy way to implement $I_1$ and $I_3$ is to have one of the currents $I_1$ and $I_3$ proportional to temperature and the other one constant to temperature.

Under these conditions, the PTAT voltage $V_{PTAT}$, the base-emitter voltage $V_{BE2}$ of the second BJT 18, and the NL voltage $V_{NL}$ may be expressed as:

$$V_{PTAT}(T)=g(m,n)T \tag{4}$$

$$V_{BE2}(T)=V_{GOr}+aT+bT\ln T \tag{5}$$

$$V_{NL}(T)=cT+dT\ln(T) \tag{6}$$

where g(m,n) is a function of 'm' (the ratio between the currents $I_2$ and $I_1$) and 'n' (the emitter area ratio between the first and second BJTs 16 and 18), such as $$g(m, n) = \frac{k}{q}\ln(nm) \tag{7}$$

where k is the Boltzmann constant, q is the elementary charge, and 'a', 'b', 'c', and 'd' are temperature independent parameters which may be expressed as:

$$\begin{cases} a = \dfrac{V_{BE2}(T_r) - V_{GOr}}{T_r} + (\eta - \delta_1)\dfrac{k}{q}\ln T_r \\ b = -(\eta - \delta_1)\dfrac{k}{q} \\ c = \dfrac{V_{BE3}(T_r) - V_{BE2}(T_r)}{T_r} + (\delta_2 - \delta_1)\dfrac{k}{q}\ln T_r \\ d = (\delta_2 - \delta_1)\dfrac{k}{q} \end{cases} \tag{8}$$

where $\eta$ is a process dependent parameter, $T_r$ is a given reference temperature, and $V_{GOr}$ is the band gap voltage of silicon extrapolated at the given reference temperature $T_r$. Typically, $V_{GOr}$ is dependent on the given reference temperature $T_r$. However, $V_{GOr}$ is temperature independent over a very wide temperature range (e.g. from −40° C. to 125° C.), and hence in the present disclosure, $V_{GOr}$ may be simplified as $V_{GO}$, which is the band gap voltage of silicon extrapolated at zero Kevin.

Herein, the base-emitter voltage $V_{BE2}$ includes a temperature independent component $V_{GO}$, a linear temperature dependent component aT, and a nonlinear temperature dependent component bTlnT. The PTAT voltage $V_{PTAT}$ includes a linear temperature dependent component g(m,n) T. The NL voltage $V_{NL}$ has a linear temperature dependent component cT, and a nonlinear temperature dependent component dTlnT. By scaling and summing the PTAT voltage $V_{PTAT}$, the base-emitter voltage $V_{BE2}$, and the NL voltage $V_{NL}$, the temperature independent $V_{GO}$ may be extracted:

$$V_{GO} = A_1V_{BE2} + A_2V_{PTAT} + A_3V_{NL}$$

$$= A_1V_{GO} + [A_1a + A_2g(m,n) + A_3c]T + [A_1b + A_3d]T\ln(T) \tag{9}$$

The scaling factors $A_1$, $A_2$, and $A_3$ have relationships:

$$\begin{cases} A_1 = 1 \\ A_2 = \dfrac{1}{g(m, n)}\left(\dfrac{bc}{d} - 1\right) \\ A_3 = -\dfrac{b}{d} \end{cases} \tag{10}$$

Herein, $[A_1a+A_2\,g(m,n)+A_3c]T$ and $[A_1b+A_3d]T\ \ln(T)$ are equal to zero. The scaled linear temperature dependent components $A_1aT$, $A_2g(m,n)T$, and $A_3cT$ cancel out one another and are not included in the $V_{GO}$. The scaled nonlinear temperature dependent components $A_1$ bTln(T) and $A_3$dTln(T) cancel out one another and are not included in the $V_{GO}$.

It is clear to those skilled in the art that the extracted $V_{GO}$ from equation (9) may be easily scaled as:

$$\alpha V_{GO} = \alpha A_1V_{BE2} + \alpha A_2V_{PTAT} + \alpha A_3V_{NL} \tag{11}$$

$$= \alpha A_1V_{GO} + \alpha[A_1a + A_2g(m, n) + A_3c]T + \alpha[A_1b + A_3d]T\ln(T)$$

Herein, $\alpha$ may be $0<\alpha\leq 1$. The relationship of the scaling factors $A_1$, $A_2$, and $A_3$ will not be affected by $\alpha$.

Figure 2:
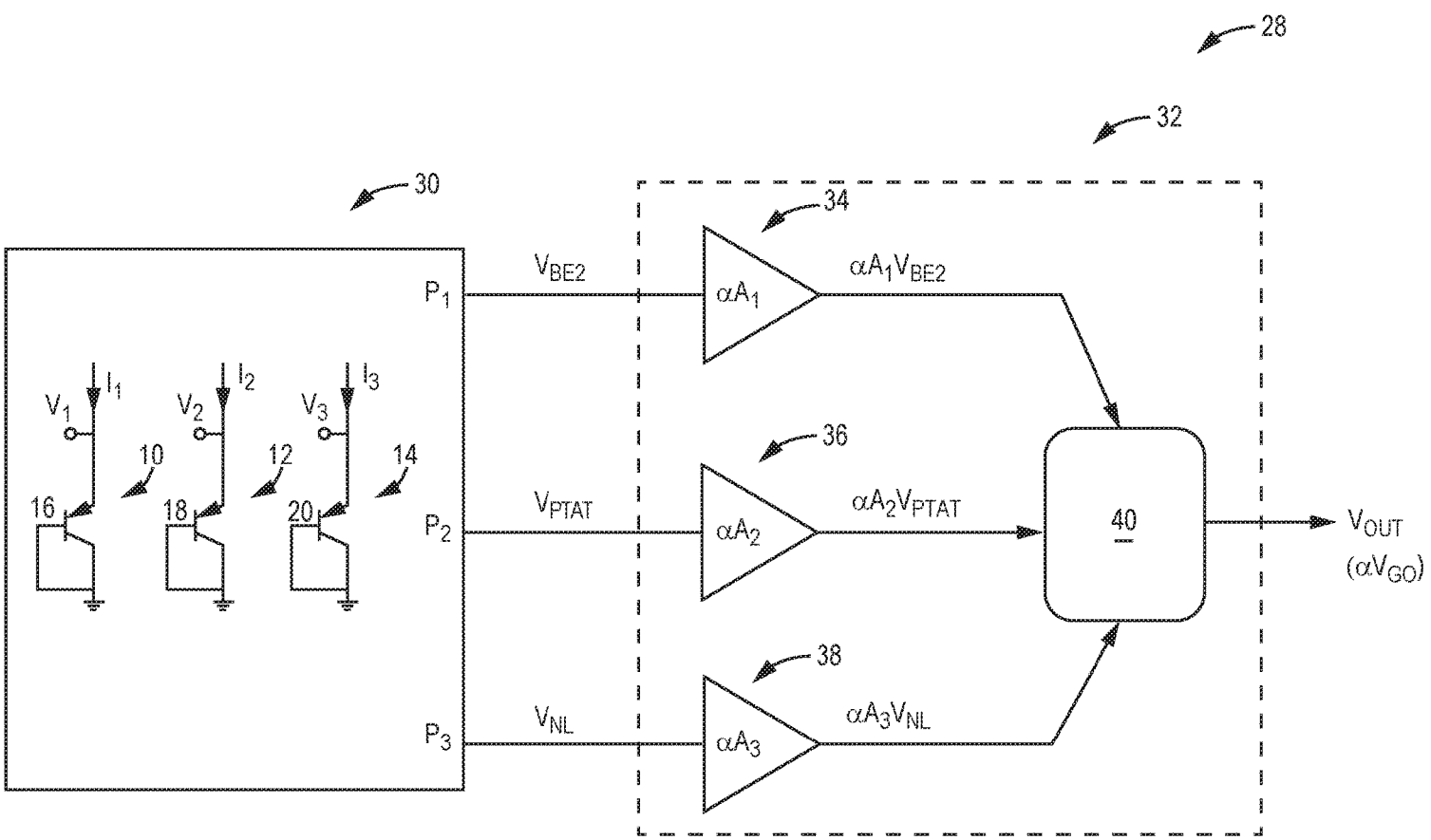
FIG. 2 shows an exemplary voltage reference generator according to one embodiment of the present disclosure.

FIG. 2 shows an exemplary voltage reference generator 28 according to one embodiment of the present disclosure. The voltage reference generator 28 includes a precursor voltage generator 30 and a voltage extractor 32. The precursor voltage generator 30 includes the first, second, and third reference units 10, 12, and 14. In different applications, the precursor voltage generator 30 may have different configurations of the first, second, and third reference units 10, 12, and 14 to generate the base-emitter voltage $V_{BE2}$, the PTAT voltage $V_{PTAT}$, and the NL voltage $V_{NL}$. Regardless of the configuration of the first, second, and third reference units 10, 12, and 14, the base-emitter voltage $V_{BE2}$, the PTAT voltage $V_{PTAT}$, and the NL voltage $V_{NL}$ are restricted to equations (4)-(8).

The base-emitter voltage $V_{BE2}$ is provided at a first port P1 of the precursor voltage generator 30, the PTAT voltage $V_{PTAT}$ is provided at a second port P2 of the precursor voltage generator 30, and the NL voltage $V_{NL}$ is provided at a third port P3 of the precursor voltage generator 30. The voltage extractor 32 is configured to receive the base-emitter voltage $V_{BE2}$, the PTAT voltage $V_{PTAT}$, and the NL voltage $V_{NL}$, and generate an output voltage $V_{OUT}$, which is equal or proportional to the temperature independent $V_{GO}$ (band gap voltage of silicon extrapolated at zero Kevin).

To describe the accuracy of the voltage reference generator 28, one typical way is to measure temperature coefficients in ppm/° C., which is defined as $$\frac{V_{OUT_MAX} - V_{OUT_MIN}}{V_{OUT_NOM}} \times \frac{1}{T_{MAX} - T_{MIN}} \times 10^6 \tag{12}$$

where, $V_{OUT_MAX}$ is the maximal output voltage of the voltage reference generator 28 over the temperature range from $T_{MAX}$ to $T_{MIN}$. $V_{OUT_MIN}$ is the minimal output voltage of the voltage reference generator 28 over the temperature range from $T_{MAX}$ to $T_{MIN}$. $V_{OUT_NOM}$ is a nominal output voltage. Ideally, if all the temperature dependency components are completely canceled, the maximal output voltage $V_{OUT_MAX}$, the minimal output voltage $V_{OUT_MIN}$, and the nominal output voltage $V_{OUT_NOM}$ of the voltage reference generator 28 will be the same. As such, the temperature coefficients of the voltage reference generator 28 will be 0 ppm/° C. In one embodiment, the voltage extractor 32 includes a first voltage scaling block 34, a second voltage scaling block 36, a third voltage scaling block 38, and a summing block 40. The first voltage scaling block 34 has a first scaling factor $\alpha A_1$, and is configured to receive the base-emitter voltage $V_{BE2}$ and provide a scaled base-emitter voltage $\alpha A_1V_{BE2}$. The second voltage scaling block 36 has a second scaling factor $\alpha A_2$, and is configured to receive the PTAT voltage $V_{PTAT}$ and provide a scaled PTAT voltage $\alpha A_2V_{PTAT}$. The third voltage scaling block 38 has a third scaling factor $\alpha A_3$, and is configured to receive the NL voltage $V_{NL}$ and provide a scaled NL voltage $\alpha A_3V_{NL}$. The first, second and third scaling factors $\alpha A_1$, $\alpha A_2$, $\alpha A_3$, have relationships as shown in equation (10). Each of the first, second and third voltage scaling blocks 34, 36, and 38 may be implemented by an operational amplifier (op-amp) and/or a resistive network. The summing block 40 is configured to receive and sum the scaled base-emitter voltage $\alpha A_1 V_{BE2}$, the scaled PTAT voltage $\alpha A_2 V_{PTAT}$, and the scaled NL voltage $\alpha A_3 V_{NL}$, and configured to provide the output voltage $V_{OUT}$. The summing block 40 may be implemented by a summing amplifier or a voltage adder. The output voltage $V_{OUT}$ is described as $$\begin{aligned} V_{OUT} &= \alpha A_1 V_{BE2} + \alpha A_2 V_{PTAT} + \alpha A_3 V_{NL} \\ &= \alpha A_1 [V_{GO} + aT + bT\ln T] + aA_2 g(m,n)T + \\ &\quad \alpha A_3 [cT + dT\ln(T)] \\ &= \alpha A_1 V_{GO} + \alpha[A_1 a + A_2 g(m,n) + A_3 c]T + \\ &\quad \alpha[A_1 b + A_3 d]T\ln(T) \end{aligned} \tag{13}$$

Since the first, second and third scaling factors $\alpha A_1$, $\alpha A_2$, $\alpha A_3$, have relationships as equation (10), $[A_1 a + A_2 g(m,n) + A_3 c]T$ and $[A_1 b + A_3 d]T \ln(T)$ are essentially equal to zero. The linear temperature dependent components aT from the base-emitter voltage $V_{BE2}$, g(m,n)T from the PTAT voltage $V_{PTAT}$, and cT from the NL voltage $V_{NL}$ cancel out one another and are not included in the $V_{OUT}$. The nonlinear temperature dependent components bTln(T) from the base-emitter voltage $V_{BE2}$ and dTln(T) from the NL voltage $V_{NL}$ cancel out one another and are not included in the $V_{OUT}$. The output voltage $V_{OUT}$ is essentially temperature independent, and proportional to $V_{GO}$, i.e., $\alpha V_{GO}$ ($0<\alpha\leq 1$). Herein, essentially temperature independent of the output voltage $V_{OUT}$ indicates that the voltage reference generator 28 providing the output voltage $V_{OUT}$ has temperature coefficients less than 1 ppm/° C.

Figure 3:
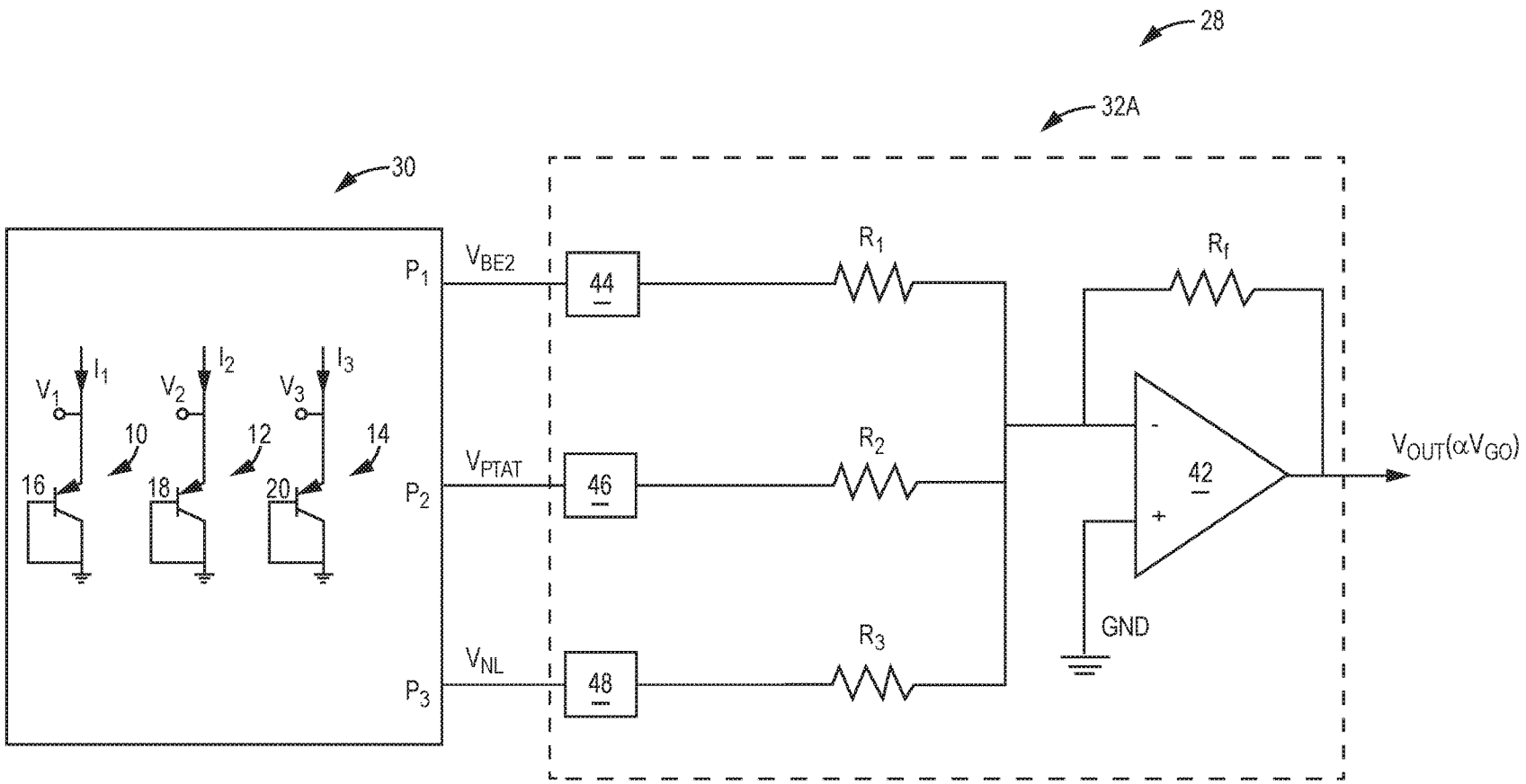
FIG. 3 shows an exemplary voltage reference generator according to one embodiment of the present disclosure.

In some applications, a voltage extractor 32A does not include the individual summing block 40, and the individual first, second, and third voltage scaling blocks 34, 36, and 38. As shown in FIG. 3, the voltage extractor 32A utilizes an op-amp 42 with a feedback resistor $R_f$, a first scaling resistor $R_1$, a second scaling resistor $R_2$, and a third scaling resistor $R_3$ to realize both scaling and summing functions. In addition, the voltage extractor 32A may also include a first buffer 44, a second buffer 46, and a third buffer 48. The first buffer 44 and the first scaling resistor $R_1$ are coupled in series between the first port P1 and a negative input of the op-amp 42. The second buffer 46 and the second scaling resistor $R_2$ are coupled in series between the second port P2 and the negative input of the op-amp 42. The third buffer 48 and the third scaling resistor $R_3$ are coupled in series between the third port P3 and the negative input of the op-amp 42. The feedback resistor $R_f$ is coupled between the negative input of the op-amp 42 and an output of the op-amp 42. A positive input of the op-amp 42 is coupled to ground, and the output voltage $V_{OUT}$ is provided at the output of the op-amp 42.

The base-emitter voltage $V_{BE2}$ is buffered by the first buffer 44 and then passed to the negative input of the op-amp 42 through the first scaling resistor $R_1$, the PTAT voltage $V_{PTAT}$ is buffered by the second buffer 46 and then passed to the negative input of the op-amp 42 through the second scaling resistor $R_2$, and the NL voltage $V_{NL}$ is buffered by the third buffer 48 and then passed to the negative input of the op-amp 42 through the third scaling resistor $R_3$. Herein, each buffer 44/46/48 may be implemented by a unit gain inverting amplifier. In this embodiment, the output voltage $V_{OUT}$ of the op-amp 42 will be expressed as:

$$V_{OUT} = -\left[V_{BE2}\frac{R_f}{R_1} + V_{PTAT}\frac{R_f}{R_2} + V_{NL}\frac{R_f}{R_3}\right] \tag{14}$$

By tuning the values of the feedback resistor Rf, the first scaling resistor $R_1$, the second scaling resistor $R_2$, and/or the third scaling resistor $R_3$, the output voltage $V_{OUT}$ of the op-amp 42 may be equal or proportional to the temperature independent voltage $V_{GO}$, where $$\begin{cases} \frac{R_f}{R_1} = A_1 = 1 \\ \frac{R_f}{R_2} = A_2 = \frac{1}{g(m,n)}\left(\frac{bc}{d} - 1\right) \\ \frac{R_f}{R_3} = A_3 = -\frac{b}{d} \end{cases} \tag{15}$$

or $$\begin{cases} \frac{R_f}{R_1} = \alpha A_1 = \alpha \\ \frac{R_f}{R_2} = \alpha A_2 = \alpha\frac{1}{g(m,n)}\left(\frac{bc}{d} - 1\right) \\ \frac{R_f}{R_3} = \alpha A_3 = -\alpha\frac{b}{d} \end{cases} \tag{16}$$

Figure 4:
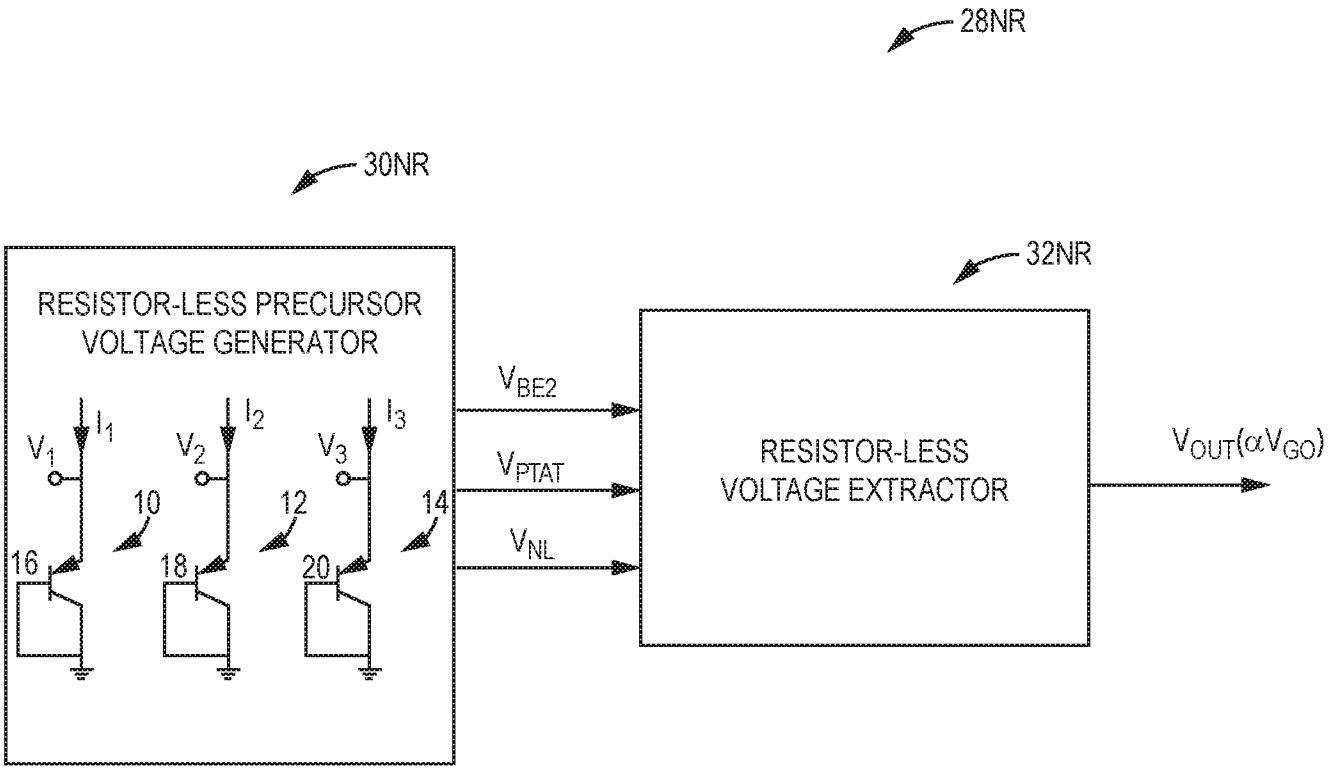
FIG. 4 shows an exemplary resistor-less voltage reference generator according to one embodiment of the present disclosure.

In some cases, the resistors $R_1$, $R_2$, $R_3$, and $R_f$ may also have temperature dependencies. Even if a same type of resistors with a same temperature dependency is utilized, the output voltage $V_{OUT}$ will still be affected. The output voltage $V_{OUT}$ of the op-amp 42 as shown in equation (13) may be not completely free of temperature dependencies. The output voltage $V_{OUT}$ may have temperature coefficients from the resistors. In order to further improve the temperature independence, a resistor-less voltage reference generator 28NR is provided as shown in FIG. 4. The resistor-less voltage reference generator 28NR includes a resistor-less precursor voltage generator 30NR and a resistor-less voltage extractor 32NR. Compared to the precursor voltage generator 30 (shown in FIGS. 2 and 3), the resistor-less precursor voltage generator 30NR further requires no resistor in addition to providing the base-emitter voltage $V_{BE2}$, the PTAT voltage $V_{PTAT}$, and the NL voltage $V_{NL}$. Compared to the voltage extractors 32 and 32A (shown in FIGS. 2 and 3), the resistor-less voltage extractor 32NR further requires no resistor in addition to receiving the base-emitter voltage $V_{BE2}$, the PTAT voltage $V_{PTAT}$, and the NL voltage $V_{NL}$, and generating the output voltage $V_{OUT}$. The output voltage $V_{OUT}$ is still essentially temperature independent, equal or proportional to the band gap voltage of silicon extrapolated at zero Kevin $V_{GO}$, and free of the temperature coefficient of the resistors.

Figure 5:
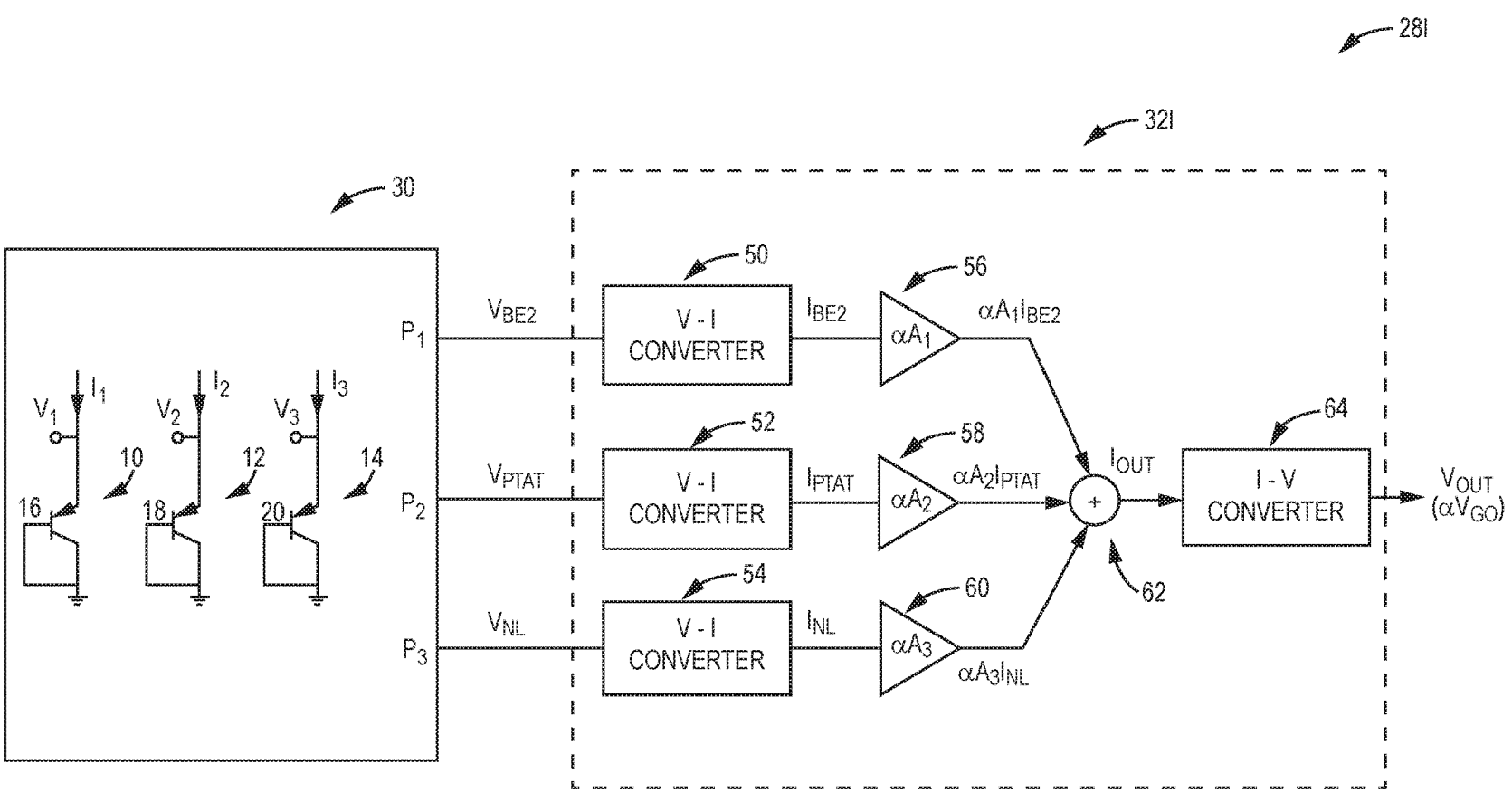
FIG. 5 shows an alternative voltage reference generator according to one embodiment of the present disclosure.

As illustrated in FIGS. 2 and 3, the scaling and summing of the base-emitter voltage $V_{BE2}$, the PTAT voltage $V_{PTAT}$, and the NL voltage $V_{NL}$ are performed in a voltage domain. In FIG. 5, an alternative voltage extractor 321, which performs the scaling and summing in a current domain, is shown. The alternative voltage extractor 321 is still configured to receive the base-emitter voltage $V_{BE2}$, the PTAT voltage $V_{PTAT}$, and the NL voltage $V_{NL}$ from the precursor voltage generator 30, and configured to generate the output voltage $V_{OUT}$. However, within the alternative voltage extractor 321, the base-emitter voltage $V_{BE2}$, the PTAT voltage $V_{PTAT}$, and the NL voltage $V_{NL}$ are not scaled or summed directly. Instead, within the alternative voltage extractor 321, the base-emitter voltage $V_{BE2}$, the PTAT voltage $V_{PTAT}$, and the NL voltage $V_{NL}$ are converted into currents for scaling and summing.

The alternative voltage extractor 321 includes a first voltage to current (V-I) converter 50, a second V-I converter 52, a third V-I converter 54, a first current scaling block 56 with the first scaling factor $\alpha A_1$, a second current scaling block 58 with a second scaling factor $\alpha A_2$, a third current scaling block 60 with a third scaling factor $\alpha A_3$, a current adder 62, and a current to voltage (1-V) converter 64. The first, second and third scaling factors $\alpha A_1$, $\alpha A_2$, $\alpha A_3$, have relationships as shown in equation (10). Each V-I converter 50/52/54 may be implemented by applying the voltage at a resistor or an operational transconductance amplifier, and each current scaling block 56/58/60 may be implemented by current mirror ratios. In some applications, each V-I converter 50/52/54 and its following current scaling block 56/58/60, respectively, may be realized as one circuit block and may be implemented by weighted voltage adder or Parallel Voltage Summer. Herein, the base-emitter voltage $V_{BE2}$ is converted into a scaled base-emitter current $\alpha A_1 I_{BE2}$ through the first V-I converter 50 and the first current scaling block 56. The PTAT voltage $V_{PTAT}$ is converted into a scaled PTAT current $\alpha A_2 I_{PTAT}$ through the second V-I converter 52 and the second current scaling block 58. The NL voltage $V_{NL}$ is converted into a scaled NL current $\alpha A_3 I_{NL}$ through the third V-I converter 54 and the third current scaling block 60.

The current adder 62 is configured to receive the scaled base-emitter current $\alpha A_1 I_{BE2}$, the scaled PTAT current $\alpha A_2 I_{PTAT}$, and the scaled NL current $\alpha A_3 I_{NL}$, and provide a summed current $I_{OUT}$ to the I-V converter 64. Based on the Kirchhoff's current law (KCL), the summed current $I_{OUT}$ is expressed as:

$$\begin{aligned} I_{OUT} &= \alpha(A_1 I_{BE2} + A_2 I_{PTAT} + A_3 I_{NL}) \\ &= \alpha\beta(A_1 V_{BE2} + A_2 V_{PTAT} + A_3 V_{NL}) \end{aligned} \tag{17}$$

$\beta$ is the voltage to current ratio from each V-I converter 50/52/54. The current adder 62 may be implemented by injecting all the currents into a resistor. In some applications, the current adder 62 may be omitted. Output ports of the first, second, and third current scaling blocks 56, 58, and 60 are connected together and coupled to the input of the I-V converter 64 (not shown).

The I-V converter 64 is configured to receive the summed current $I_{OUT}$ and provide the summed output voltage $V_{OUT}$ expressed as:

$$\begin{aligned} V_{OUT} &= \alpha(A_1 I_{BE2} + A_2 I_{PTAT} + A_3 I_{NL}) \times \frac{1}{\beta} \\ &= \alpha A_1 V_{BE2} + \alpha A_2 V_{PTAT} + \alpha A_3 V_{NL} \end{aligned} \tag{18}$$

$$\frac{1}{\beta}$$

is the current to voltage ratio from the I-V converter 64. The I-V converter 64 may be implemented by applying the current at a resistor or an operational transimpedance amplifier. Since the first, second and third scaling factors $\alpha A_1$, $\alpha A_2$, $\alpha A_3$, have relationships as equation (10), the summed output voltage $V_{OUT}$ is essentially temperature independent and proportional to $V_{GO}$, i.e., $\alpha V_{GO}$ ($0<\alpha\leq 1$).

Figure 6:
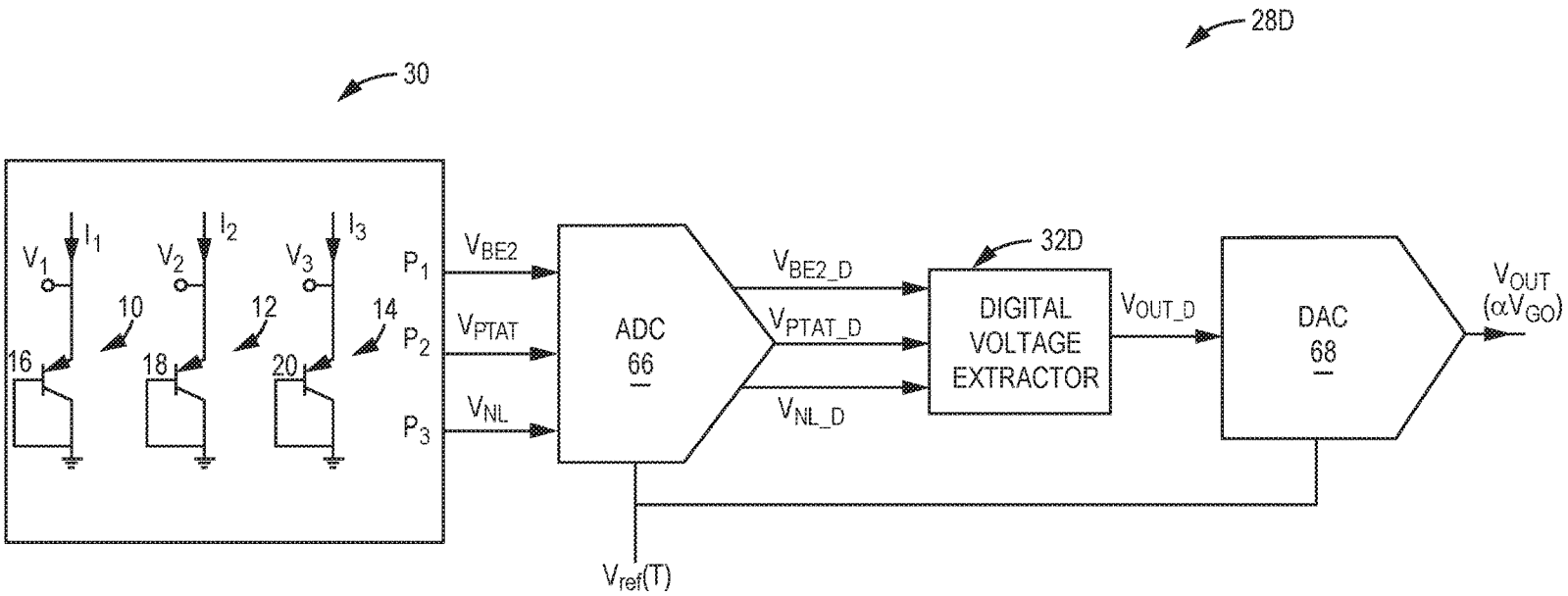
FIG. 6 shows an exemplary voltage reference generator with digital voltage extractor according to one embodiment of the present disclosure.

In another embodiment, a voltage reference generator 28D performs the scaling and summing in a digital domain. As shown in FIG. 6, the voltage reference generator 28D includes the precursor voltage generator 30, an analog-to-digital converter (ADC) 66, a digital voltage extractor 32D, and a digital-to-analog converter (DAC) 68. The ADC 66 is configured to receive the base-emitter voltage $V_{BE2}$, the PTAT voltage $V_{PTAT}$, and the NL voltage $V_{NL}$ from the precursor voltage generator 30, and provide a digital base-emitter voltage $V_{BE2_D}$, a digital PTAT voltage $V_{PTAT_D}$, and a digital NL voltage $V_{NL_D}$ to the digital voltage extractor 32D. In some applications, the voltage reference generator 28D may include more than one ADC 66. For instance, one of the ADCs 66 may be used for transferring the base-emitter voltage $V_{BE2}$, one of the ADCs 66 may be used for transferring the PTAT voltage $V_{PTAT}$, and one of the ADCs 66 may be used for transferring the NL voltage $V_{NL}$ (not shown).

Within the digital voltage extractor 32D, the digital base-emitter voltage $V_{BE2_D}$, the digital PTAT voltage $V_{PTAT_D}$, and the digital NL voltage $V_{NL_D}$ are scaled by the first, second, and third scaling factors $\alpha A_1$, $\alpha A_2$, and $\alpha A_3$, respectively, and then summed together to provide a digital summed output voltage $V_{OUT_D}$ as:

$$V_{OUT_D} = \alpha A_1 V_{BE2_D} + \alpha A_2 V_{PTAT_D} + \alpha A_3 V_{NL_D} \tag{19}$$

The first, second and third scaling factors $\alpha A_1$, $\alpha A_2$, $\alpha A_3$, have relationships as equation (10), such that the digital summed output voltage $V_{OUT_D}$ is temperature independent. The digital voltage extractor 32D may be provided by a digital signal processor (DSP).

The DAC 68 is configured to transfer the digital summed output voltage $V_{OUT_D}$ back to the output voltage $V_{OUT}$ in an analog domain. The output voltage $V_{OUT}$ is essentially temperature independent and proportional to $V_{GO}$, i.e., $\alpha V_{GO}$ ($0<\alpha\leq 1$). Herein, a first reference voltage $V_{ref1}(T)$ used in the ADC 66 and a second reference voltage $V_{ref2}(T)$ used in the DAC 68 will have a same temperature dependency. In one embodiment, the ADC 66 and the DAC 68 share a same reference voltage $V_{ref}(T)$. Since both the ADC 66 and the DAC 68 are ratio-metric devices, the same $V_{ref}(T)$ ensures that the temperature dependency from the ADC 66 and the DAC 68 will be cancelled out.

Those skilled in the art will recognize improvements and modifications to the preferred embodiments of the present disclosure. All such improvements and modifications are considered within the scope of the concepts disclosed herein and the claims that follow.

What is claimed is:

1. An apparatus comprising:

a precursor voltage generator comprising a first reference unit generating a first voltage, a second reference unit generating a second voltage, and a third reference unit generating a third voltage, wherein the precursor voltage generator is configured to provide:

the second voltage that includes a temperature independent component, a first linear temperature dependent component, and a first nonlinear temperature dependent component;

a proportional-to-absolute-temperature (PTAT) voltage that is a function of the first voltage and the second voltage, and includes a second linear temperature dependent component; and a nonlinear (NL) voltage that is a function of the second voltage and the third voltage, and includes a third linear temperature dependent component and a second nonlinear temperature dependent component; and a voltage extractor configured to generate an output voltage by scaling and summing the second voltage, the NL voltage, and the PTAT voltage, wherein:

the first linear temperature dependent component, the second linear temperature dependent component, and the third linear temperature dependent component are scaled and cancel out one another, so as to be eliminated from the output voltage;

the first nonlinear temperature dependent component and the second nonlinear temperature dependent component are scaled and cancel out one another, so as to be eliminated from the output voltage; and the output voltage is essentially temperature independent and proportional to the temperature independent component.

2. The apparatus of claim 1 wherein the precursor voltage generator and the voltage extractor are free of resistors.

3. The apparatus of claim 1 wherein each of the first reference unit, the second reference unit, and the third reference unit comprises a diode.

4. The apparatus of claim 1 wherein each of the first reference unit, the second reference unit, and the third reference unit comprises a bipolar junction transistor (BJT), wherein a base of the BJT and a collector of the BJT are shorted.

5. The apparatus of claim 1 wherein a first current injected into the first reference unit and a second current injected into the second reference unit have a same temperature dependency, and the first current and a third current injected into the third reference unit have different temperature dependencies.

6. The apparatus of claim 1 wherein the output voltage is equal to the temperature independent component.

7. The apparatus of claim 1 wherein the output voltage is smaller than the temperature independent component.

8. The apparatus of claim 1 wherein the temperature independent component is a band gap voltage of silicon extrapolated at zero Kevin.

9. The apparatus of claim 1 wherein the voltage extractor comprises a first voltage scaling block, a second voltage scaling block, a third voltage scaling block, and a summing block, wherein:

the first voltage scaling block has a first scaling factor, and is configured to receive the second voltage and provide a scaled second voltage;

the second voltage scaling block has a second scaling factor, and is configured to receive the PTAT voltage and provide a scaled PTAT voltage;

the third voltage scaling block has a third scaling factor, and is configured to receive the NL voltage and provide a scaled NL voltage;

the first scaling factor, the second scaling factor, and the third scaling factor are different; and the summing block is configured to receive and sum the scaled second voltage, the scaled PTAT voltage, and the scaled NL voltage, and configured to provide the output voltage.

10. The apparatus of claim 9 wherein each of the first voltage scaling block, the second voltage scaling block, and the third voltage scaling block is implemented by at least one of an operational amplifier (op-amp) and a resistive network.

11. The apparatus of claim 9 wherein the summing block is implemented by a summing amplifier or a voltage adder.

12. The apparatus of claim 1 wherein:

the second voltage is provided at a first port of the precursor voltage generator, the PTAT voltage is provided at a second port of the precursor voltage generator, and the NL voltage is provided at a third port of the precursor voltage generator; and the voltage extractor comprises a first scaling resistor, a second scaling resistor, a third scaling resistor, a feedback resistor, and an op-amp, wherein:

the first scaling resistor is coupled between the first port and a negative input of the op-amp, the second scaling resistor is coupled between the second port and the negative input of the op-amp, and the third scaling resistor is coupled between the third port and the negative input of the op-amp;

the first scaling resistor, the second scaling resistor, and the third scaling resistor have different resistances;

the feedback resistor is coupled between the negative input of the op-amp and an output of the op-amp; and a positive input of the op-amp is coupled to ground, and the output voltage is provided at the output of the op-amp.

13. The apparatus of claim 12 wherein the voltage extractor further comprises a first buffer coupled between the first port and the first scaling resistor, a second buffer coupled between the second port and the second scaling resistor, and a third buffer coupled between the third port and the third scaling resistor.

14. The apparatus of claim 13 wherein each of the first buffer, the second buffer, and the third buffer is implemented by a unit gain inverting amplifier.

15. An apparatus comprising:

a precursor voltage generator comprising a first reference unit generating a first voltage, a second reference unit generating a second voltage, and a third reference unit generating a third voltage, wherein the precursor voltage generator is configured to provide:

the second voltage that includes a temperature independent component, a first linear temperature dependent component, and a first nonlinear temperature dependent component;

a proportional-to-absolute-temperature (PTAT) voltage that is a function of the first voltage and the second voltage, and includes a second linear temperature dependent component; and a nonlinear (NL) voltage that is a function of the second voltage and the third voltage, and includes a third linear temperature dependent component and a second nonlinear temperature dependent component; and a voltage extractor providing an output voltage, wherein:

the voltage extractor is configured to convert and scale the second voltage, the PTAT voltage, and the NL voltage into a scaled second current, a scaled PTAT current, and a scaled NL current, respectively;

the voltage extractor is configured to sum the scaled second current, the scaled PTAT current, and the scaled NL current and provide a summed current, wherein:

the first linear temperature dependent component, the second linear temperature dependent component, and the third linear temperature dependent component are scaled and cancel out one another, so as to be eliminated from the summed current; and the first nonlinear temperature dependent component and the second nonlinear temperature dependent component are scaled and cancel out one another, so as to be eliminated from the summed current; and the voltage extractor is configured to convert the summed current into the output voltage, which is essentially temperature independent and proportional to the temperature independent component.

16. The apparatus of claim 15 wherein the voltage extractor comprises a first voltage to current (V-I) converter, a second V-I converter, a third V-I converter, a first current scaling block, a second current scaling block, a third current scaling block, and a current to voltage (I-V) converter, wherein:

the second voltage is converted to the scaled second current by the first V-I converter and the first current scaling block;

the PTAT voltage is converted to the scaled PTAT current by the second V-I converter and the second current scaling block;

the NL voltage is converted to the scaled NL current by the third V-I converter and the third current scaling block; and the I-V converter is configured to convert the summed current into the output voltage.

17. The apparatus of claim 16 wherein the voltage extractor further comprises a current adder, wherein the current adder is configured to receive the scaled second current, the scaled PTAT current, and the scaled NL current, and provide the summed current to the I-V converter.

18. The apparatus of claim 16 wherein a first output port of the first current scaling block, a second output port of the second current scaling block, and a third output port of the third current scaling block are connected together and coupled to an input of the I-V converter.

19. An apparatus comprising:

a precursor voltage generator comprising a first reference unit generating a first voltage, a second reference unit generating a second voltage, and a third reference unit generating a third voltage, wherein the precursor voltage generator is configured to provide:

the second voltage that includes a temperature independent component, a first linear temperature dependent component, and a first nonlinear temperature dependent component;

a proportional-to-absolute-temperature (PTAT) voltage that is a function of the first voltage and the second voltage, and includes a second linear temperature dependent component; and a nonlinear (NL) voltage that is a function of the second voltage and the third voltage, and includes a third linear temperature dependent component and a second nonlinear temperature dependent component; and an analog to digital converter (ADC) coupled to the precursor voltage generator and configured to convert the second voltage, the PTAT voltage, and the NL voltage from an analog domain to a digital domain;

a digital voltage extractor configured to generate an output voltage by scaling and summing the second voltage, the NL voltage, and the PTAT voltage in the digital domain, such that:

the first linear temperature dependent component, the second linear temperature dependent component, and the third linear temperature dependent component are scaled and cancel out one another, so as to be eliminated from the output voltage;

the first nonlinear temperature dependent component and the second nonlinear temperature dependent component are scaled and cancel out one another, so as to be eliminated from the output voltage; and the output voltage is essentially temperature independent and proportional to the temperature independent component; and a digital to analog converter (DAC) configured to convert the output voltage from the digital domain to the analog domain.

20. The apparatus of claim 19 wherein the digital voltage extractor is implemented by a digital signal processor.

21. The apparatus of claim 19 wherein the ADC and the DAC share a same reference voltage.

* * * * *